US008933683B2

(12) United States Patent
Singnurkar

(10) Patent No.: US 8,933,683 B2
(45) Date of Patent: Jan. 13, 2015

(54) BAND GAP REFERENCE CIRCUIT

(75) Inventor: Pramod Singnurkar, Graz (AT)

(73) Assignee: AMS AG, Unterpremstätten (AT)

( * ) Notice: Subject to any disclaimer, the term of this patent is extended or adjusted under 35 U.S.C. 154(b) by 396 days.

(21) Appl. No.: 13/028,723

(22) Filed: Feb. 16, 2011

(65) Prior Publication Data

US 2011/0199069 A1 Aug. 18, 2011

(30) Foreign Application Priority Data

Feb. 17, 2010 (EP) ..... 10001619

(51) Int. Cl.
*G05F 3/16* (2006.01)
*G05F 3/30* (2006.01)

(52) U.S. Cl.
CPC ..... *G05F 3/30* (2013.01)
USPC ..... 323/316

(58) Field of Classification Search
USPC ..... 323/312–316
See application file for complete search history.

(56) References Cited

U.S. PATENT DOCUMENTS 5,892,388 A 4/1999 Chiu
6,150,872 A 11/2000 McNeill et al.
6,157,270 A 12/2000 Tso
7,034,514 B2 * 4/2006 Tachibana et al. ..... 323/313
7,994,766 B2 * 8/2011 De Lima Filho et al. ..... 323/282
2002/0093324 A1 * 7/2002 Juang ..... 323/316
2005/0088163 A1 4/2005 Tachibana et al.

OTHER PUBLICATIONS

C. Yao et al., "A 14-μA 3-ppm/° C CMOS Bandgap Voltage Reference", ASIC, 2005, 6th Int. Conference, IEEE LNKD-DOI:10.1109/ICASIC, vol. 1, pp. 524-527, Oct. 24, 2005.

* cited by examiner

*Primary Examiner* — Adolf Berhane
*Assistant Examiner* — Afework Demisse
(74) *Attorney, Agent, or Firm* — McDermott Will & Emery LLP

(57) ABSTRACT

A band gap reference circuit comprises a first branch (1) having a first transistor (Q1) and a first temperature-dependent resistive element (S0). A second branch of the band gap reference comprises a second transistor (Q2) having a different size compared to the first transistor (Q1). An output branch (3) comprises a second temperature-dependent resistive element (S1, S2), that second temperature-dependent resistive element being coupled to an output terminal (Vref). At least one of the first and second temperature-dependent resistive elements (S0, S1, S2) comprises a transistor (M2) being arranged in a current path of the respective branch (1, 3) and being controlled such that it operates in a linear region of its characteristics.

19 Claims, 7 Drawing Sheets

PRIOR ART

BAND GAP REFERENCE CIRCUIT

RELATED APPLICATIONS

This application claims the priority of European application no. 10001619.5 filed Feb. 17, 2010, the entire content of which is hereby incorporated by reference.

FIELD OF THE INVENTION

The present invention is related to a band gap reference circuit also known as a band gap voltage reference.

BACKGROUND OF THE INVENTION

Band gap voltage references are reference circuits widely used in integrated circuits, usually to provide a temperature-stabilized output voltage. The reference circuit uses the voltage difference between two pn-junctions operated at different current densities. The voltage difference may generate a current proportional to absolute temperature in a first resistor, which is then used in a subsequent step to generate a voltage in a second resistor. Said voltage in turn is added to the voltage of an additional pn-junction and may provide a current which is complementary to absolute temperature. If the ratio between the first and second resistor is chosen properly, the first order effects of the temperature dependency of the pn-junction and the temperature-depending current will cancel each other out.

FIG. 8 shows a known band gap reference circuit comprising a first branch with transistor M1, resistor R1 and bipolar transistor Q1 connected in series. A second branch comprises transistor M2 and bipolar transistor Q2 also connected in series. A node in the first and second branches, particularly between the transistors M1, M2 and the respective bipolar transistors Q1 and Q2 are connected to a common comparator A providing a control signal Vg controlling field-effect transistors M1, M2, respectively. The output of comparator A is also connected to transistor M5 being part of an output branch also comprising resistor R6 and bipolar transistor Q3.

In operation, the control signal Vg corresponding to the gate voltages of transistors M1, M2, and M5 controls the current through transistors M1 and M2 such that voltages V1, V2 at nodes 10 and 11, respectively, are equal. At the same time, resistor R1, a floating resistor, comprises a temperature dependency. Similarly, output resistor R6 comprises the same or bigger resistance value and therefore a stronger temperature dependency compared to resistor R1. The voltage across transistor Q3 comprises the opposite temperature dependency, for instance the complementary to absolute temperature dependency. As a result, both temperature dependencies of a voltage across resistor R6 and transistor Q3 will cancel each other, thus resulting in a constant output voltage Vref. The output voltage Vref is given by the voltages across transistor Q3 and the voltage through resistor R6.

When realizing the band gap reference according to FIG. 8 in a semiconductor material as an integrated circuit, one has to implement resistors R1, R6, both in the range of several Mohms, resulting in an increase of the space required in the semiconductor material, particularly, if low currents are required.

SUMMARY OF THE INVENTION

One object of the present invention is to implement band gap reference circuitry in a semiconductor material having a smaller size but at the same time providing a stable output voltage.

One aspect of the invention proposes a new band gap reference using field-effect transistors to generate voltages which are proportional to absolute temperatures instead of using resistors. Accordingly, a band gap reference circuit according to an embodiment of the present invention requires only field-effect transistors and bipolar transistors, wherein the field-effect transistors may comprise a positive temperature dependency, meaning that the resistance will increase with increasing temperature, while bipolar transistors may be used comprising a positive or negative temperature dependency.

Using transistors instead of polyresistors, the size of a band gap reference can be reduced by a factor of 4 for the same power consumption compared to a standard band gap reference. At the same time, higher output voltages can be achieved.

In an embodiment, a band gap reference circuit may comprise a first branch comprising a first transistor element and a first temperature-dependent resistive element. A second branch may comprise a second transistor element having a different size compared to the first transistor element. The band gap reference may also comprise an output branch comprising a second temperature-dependent resistive element, that second temperature-dependent resistive element being coupled to an output terminal. A control element may be coupled to the first and second branch to control a current through the first and second branches. For instance the control element may comprise a comparator or a current mirror or other suitable elements.

In accordance with an embodiment of the present invention, at least one of the first and second temperature-dependent resistive elements may comprise a transistor being arranged in a current path of the respective branch. The transistor is controlled by a control signal such that it operates in a linear region of its characteristics. As a result, the transistor is operated to behave like a resistor with a proportional temperature dependency. This is achieved by operating the respective transistor in a linear region of its characteristics.

In an embodiment at least one of the first and second temperature-dependent resistive elements may comprise a transistor being arranged in a current path of the respective branch. The transistor is controlled by a controller adopted to provide a control signal to the transistor to operate the transistor in a linear region of its characteristics.

In an embodiment, each of the first and second temperature-dependent resistive elements may comprise a respective transistor being arranged in a current path of the respective branch. Both temperature-dependent resistive elements may have a control element for providing the respective control signal or share a common control element. The temperature dependency of the respective transistor in the first and second temperature-dependent resistive elements can be equal. Particularly, the transistors of the respective first and second temperature-dependent resistive elements may comprise the same channel length and/or channel width or the same width/length ratio to ensure similar characteristics.

In a further embodiment, the output branch may also comprise a transistor being connected in series to the second temperature-dependent resistive element, wherein the transistor comprises a temperature dependency being opposite to the temperature dependency of the second temperature-dependent resistive element. Accordingly, the temperature dependency of the second resistive element may be chosen such that both temperature dependencies may cancel each other out in operation of the band gap reference.

To ensure an operation of the transistor in the linear region of their characteristics, the first temperature-dependent element may comprise a first current mirror, said current mirror comprising a first input transistor and a first mirror transistor. The mirror transistor corresponds to the transistor operated in the linear region of its characteristics. The control terminal of the mirror transistor as well as the control terminal of the first input transistor is coupled to a first terminal of the input transistor, thereby forming the current mirror. In this respect, the input transistor may be operated in a saturated region of its characteristics.

In an embodiment, the mirror transistor may comprise a channel width which is greater than a respective channel width of the input transistor. Consequently, the input transistor of the first current mirror may be operated in a saturated region of its characteristics, while the mirror transistor is operated in a linear region of its characteristics. For instance, the channel width of the mirror transistor may be K-times greater than the respective channel width of the input transistor.

In a further embodiment, the second temperature-dependent resistive element may comprise a second current mirror, said second current mirror comprising a second input transistor and a second mirror transistor. The second mirror transistor corresponds to the transistor adopted to operate in a linear region of its characteristics. Again, each control terminal of both transistors is coupled to a terminal of the second input transistor. Accordingly, first and second temperature-dependent resistive elements may each comprise a respective current mirror. The current mirrors of both resistive elements may comprise a similar or even the same structure. Particularly, the mirror transistor of the respective current mirror may comprise the same channel width and/or channel length.

By connecting a plurality of such current mirrors in series, it is possible to increase the output voltage of the band gap reference to a desired value. In an embodiment, the second temperature-dependent resistive element comprises a plurality of current mirrors, wherein each current mirror comprises an input transistor and a mirror transistor. Each control terminal of both transistors is coupled to a first terminal of the respective input transistor. A terminal of the current mirror transistor of at least one of the plurality of current mirrors is coupled to a second terminal of an input transistor of a subsequent current mirror.

In yet another embodiment, the output branch may comprise a transistor having a specific temperature dependency and a resistive element, comprising an opposite temperature dependency. The resistive element comprises a transistor adopted to operate in a linear region of its characteristics, thereby canceling out the temperature dependency of the transistor within the output branch. The resistive element in the output branch may also comprise a controller for controlling the transistor to operate in the linear region of its characteristics.

In an embodiment, a transistor of the second temperature-dependent resistive element being operated in a linear region of its characteristics may comprise a channel length greater than a channel length of a transistor of the first temperature-dependent resistive element. Both transistors are adopted to operate in the linear region of their respective characteristics by applying respective control signal thereto.

In an embodiment, the output branch may comprise a current transistor having a temperature dependency opposite to the temperature dependency of the second temperature-dependent resistive element. In another embodiment, the first transistor of the first branch may comprise a temperature dependency opposite to the temperature dependency of the second temperature-dependent resistive element. A node between the first temperature-dependent resistive element and the first transistor in the first branch is connected to a node between the second temperature-dependent resistive element and a reference terminal in the output branch. Accordingly, the temperature dependency of the transistor in the first branch is canceled out by the temperature dependency of the second resistive element.

DETAILED DESCRIPTION OF THE DRAWINGS

In the following detailed description, several aspects of the present invention are explained in greater detail with reference to the accompanying drawings. Features illustrated in the figures are not restricted to the respective embodiments but can be combined in different ways by a person skilled in the art. For instance, the embodiment illustrates band gap references using field-effect transistors and bipolar transistors of a specific kind. However, field-effect transistors and bipolar transistors of different types can be used as well. Further, some field-effect transistors can be replaced by other elements without changing the scope of the invention. While the present invention is implemented using a specific kind of band gap reference, the illustrated principle to replace a poly-resistor within the band gap reference by current mirrors using field-effect transistors, one of those transistors being operated in a linear region of its characteristics can be implemented in different types of band gap references. Similar circuits, nodes and elements bear the same reference signs.

Figure 1:
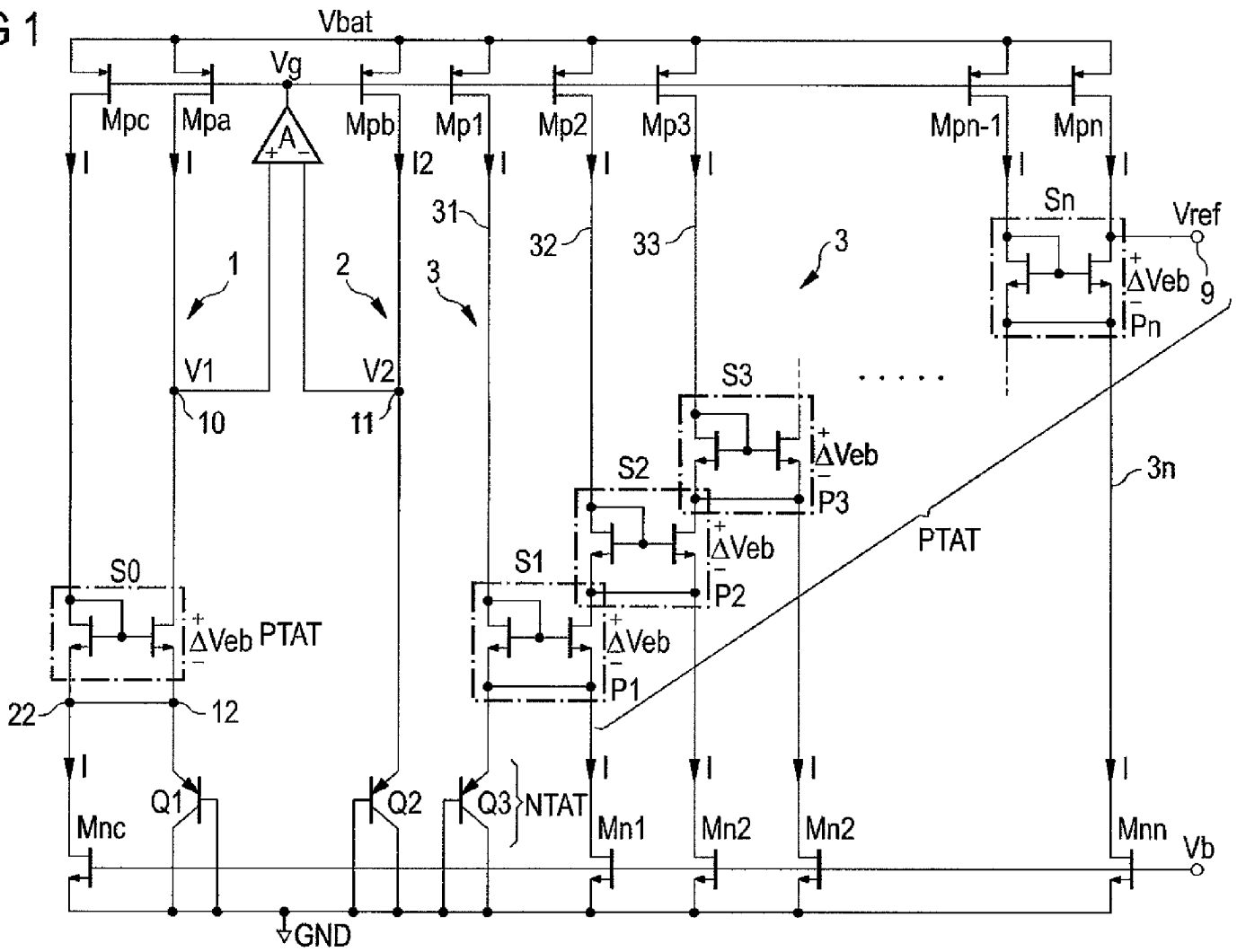
FIG. 1 illustrates a first embodiment of a band gap reference circuit.

FIG. 1 illustrates a first embodiment of a band gap reference according to the present invention. The band gap reference comprises a first branch 1, including a field-effect transistor Mpa being coupled to supply terminal Vbat, a node 10 and to a terminal of a mirror transistor of a temperature-dependent element S0. A second terminal of said mirror transistor at node 12 is connected to an emitter of a bipolar transistor Q1, whose base and collector are coupled to the reference terminal GND.

The temperature-dependent element S0 comprises a current mirror of two transistors, one transistor being the mirror transistor and connected in the current path of the first branch 1. The other transistor is referred to as input transistor is coupled with one terminal to node 22 and to bias transistor Mnc. Node 22 is also connected to node 12, thereby equalizing the voltage at the output of the temperature resistive element S0. The other terminal of the input transistor of element S0 is coupled to the control terminals of both transistors within the current mirror. The terminal and the control terminals of both transistors are also coupled to the supply terminal Vbat via transistor Mpc.

The temperature resistive element provides a voltage over its mirror transistor which is proportional to absolute temperature, indicated by reference PTAT.

Figure 2:
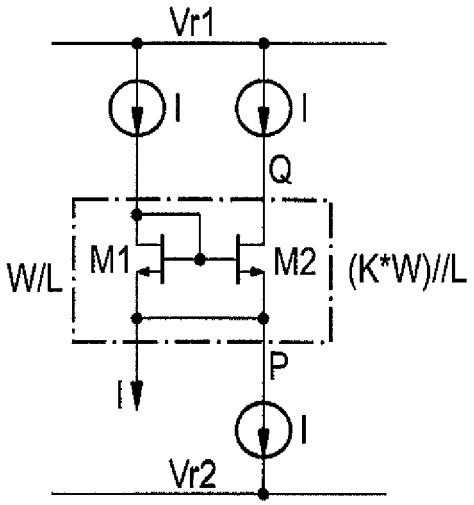
FIG. 2 shows an embodiment of a temperature-dependent resistive element used in the band gap references.

In this respect, FIG. 2 illustrates the structure of the temperature resistive element in greater detail. Transistors M1 and M2 of the current mirror representing the temperature resistive element carry equal currents I indicated in FIG. 2 by constant current sources connected thereto. Further, the gate-to-source voltages of both transistors M1 and M2 are also equal. However, as shown in FIG. 2, transistor M1 comprises a channel width to channel length ratio W/L while transistor M2 differs in the channel width by a factor of K. Consequently, the channel width of transistor M2 is K-times the size of the channel width W of transistor M1.

As a result, although both transistors may comprise the same gate-to-source voltages, the drain-to-source voltage of both transistors are different due to the different sizes.

In operation, transistor M1 will operate in a saturation region of its characteristics due to the connection between its source terminal and its gate terminal. By choosing the channel width of transistor M2 properly, i.e. adjusting factor K to a respective value, transistor M2 will operate in its linear region of its characteristics due to its greater channel width. As a result, transistor M2 will behave like a resistor with a specific input and output voltage. The voltage at its input terminal Q will be level shifted by the voltage across the transistor M2. If a plurality of such stages is coupled together, the voltage at node P can be level shifted to a much higher value. Transistor M2 also acts not as a floating resistor, but with a well defined level.

Referring now to FIG. 1, the voltage at nodes 12 and 22, respectively, is given by the collector emitter voltage of transistor Q1, the voltage V1 at node 10 is given by $$V1=\Delta Veb+V_{Q1}$$

The band gap reference also comprises a second branch 2 including transistor Mpb and transistor Q2 connected in series between the supply potential Vbat and the reference potential GND. A node 11 between transistor Mpb and transistor Q2 provides a voltage V2 and is coupled to a comparator A. Comparator A generates a control voltage Vg applied to control terminals of transistors Mpa in the first branch and Mpb in the second branch such that the voltages V1 and V2 at nodes 10 and 11, respectively, are equal:

$$V1=V2$$

if the sizes between the bipolar transistors Q1 and Q2 in the respective first and second branch are different, the emitter-base voltage $V_{Q2}$ of bipolar transistor Q2 is given by $$V_{Q2}=V_{Q1}+\Delta Veb,$$

wherein ΔVeb is the voltage across the mirror transistor of voltage dependent element S0.

As per the theory of band gap references, voltage ΔVeb has positive temperature coefficient.

The band gap reference also comprises an output branch 3. Output branch 3 includes a second temperature-dependent element comprising a plurality of stacked current mirrors thus providing a level shifted output voltage Vref.

For that purpose, the output branch 3 comprises a first branch 31 including a transistor Mp1 coupled to the supply terminal Vbat and to the input terminal of a current mirror S1. The output terminal of input transistor of current mirror S1 is connected to a bipolar transistor Q3 providing a negative voltage temperature coefficient. Transistor Mp1, input transistor of current mirror S1 and bipolar transistor Q3 are forming a first sub-branch 31 of output branch 3.

Current mirror S1 comprises a current mirror transistor on "its right side", said mirror transistor having an output terminal P1 coupled via bias transistor Mn1 to a ground terminal. The other terminal of the mirror transistor of current mirror S1 is connected to an output terminal of an input transistor of current mirror S2 in a second sub-branch 32 of the output branch 3. Further, the mirror transistor of current mirror S2 is connected with its output terminal P2 to ground terminal GND via bias transistor Mn2. The input terminal of the mirror transistor of current mirror S2 is connected to the output terminal of input transistor of current mirror S3 in the sub-branch 33 and so forth.

Several of those elements including current mirrors S1, S2 and S3 can be stacked together to provide an output voltage Vref at the output terminal, wherein Vref is given by n-times ΔVeb and n is the number of mirrors stacked together. As each of the mirror transistors of the current mirrors acts as a level shifter, the total output is given by the sum of each voltage shift by the level shifters plus the Voltage of transistor Q3.

In this particular embodiment, the channel width of the mirror transistors in the respective current mirrors S1 to Sn of each sub-branch is equal to the channel width of the mirror transistor in current mirror S0 of the first temperature-dependent element. As a result, the level-shifted voltages across the mirror transistors of current mirrors 31 to Sn are also ΔVeb. As a result, the output voltage Vref is given by $$Vref=V_{Q3}+n*\Delta Veb,$$

wherein n represents the number of current mirrors and $V_{Q3}$ is the emitter-base voltage of transistor Q3. By selecting a proper current I2 in branch 2 of the band gap reference, ΔVeb can be adjusted properly so that an integer value of n can be found. As a result, Vref comprises almost no temperature dependency.

Bias transistors Mnc, Mn1, Mn2, Mn3 to Mnn are each connected to bias terminal Vb. A voltage applied to the bias terminal ensures a stable current I through the respective branches and sub-branches and can be derived from the control voltage Vg.

Figure 3:
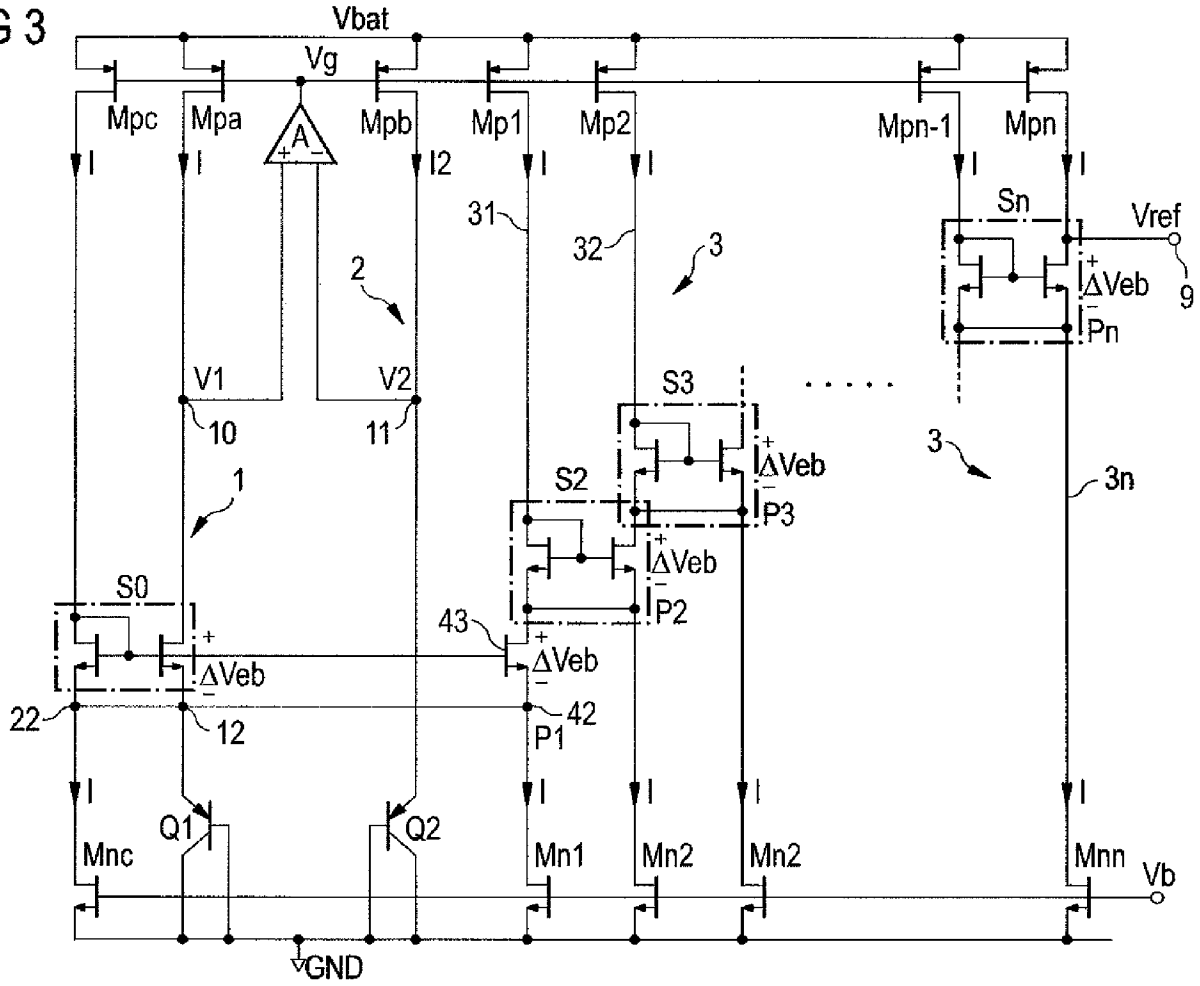
FIG. 3 shows a second embodiment of a band gap reference circuit.

FIG. 3 illustrates a slightly different embodiment of a band gap reference according to the present invention. In this embodiment, the temperature dependency of the first bipolar transistor Q1 in the first branch of the band gap reference is used to provide a constant output voltage Vref. For that purpose, node 12 is connected to node 42 in output branch 3. In this embodiment, first sub-branch 31 of output branch 3 comprises a single transistor 43, coupled with a first terminal to node 42 and bias transistor Mn1 and with a second terminal to the output terminal of the input transistor of current mirror S2. The gate of transistor 43 is connected to the gates of the mirror transistor and the input transistor of the first temperature-dependent element S0.

As a result, the input transistor of mirror S0 acts as commonly shared control element, providing a control signal to operate mirror transistor of mirror S0 and transistor 43 in a linear region of its characteristics.

In this embodiment, channel length and channel width of transistor 43 is equal to the mirror transistor of current mirror S0. Accordingly, the source-drain voltage across transistor 43 is given approximately by ΔVeb and corresponds to the voltage across the mirror transistor of current mirror S0. Again, the voltage is level shifted by additional current mirror elements S2, S3 to Sn connected as a stack in several sub-branches of the output branch 3.

The total output reference voltage Vref is given by $$Vref=n*\Delta Veb+V_{Q1},$$

wherein n is the number of current mirrors and particularly the mirror transistors being operated in a linear region of its characteristics each providing a voltage drop of ΔVeb. $V_{Q1}$ represents the emitter base voltage of bipolar transistor Q1.

In the previous embodiments, the output voltage Vref was mainly generated by level shifting the voltage ΔVeb given by the reference between the emitter base voltage of bipolar transistors Q1 and Q2 using a number of stacked current sources with a mirror transistor being controlled to operate in a linear region.

Figure 4:
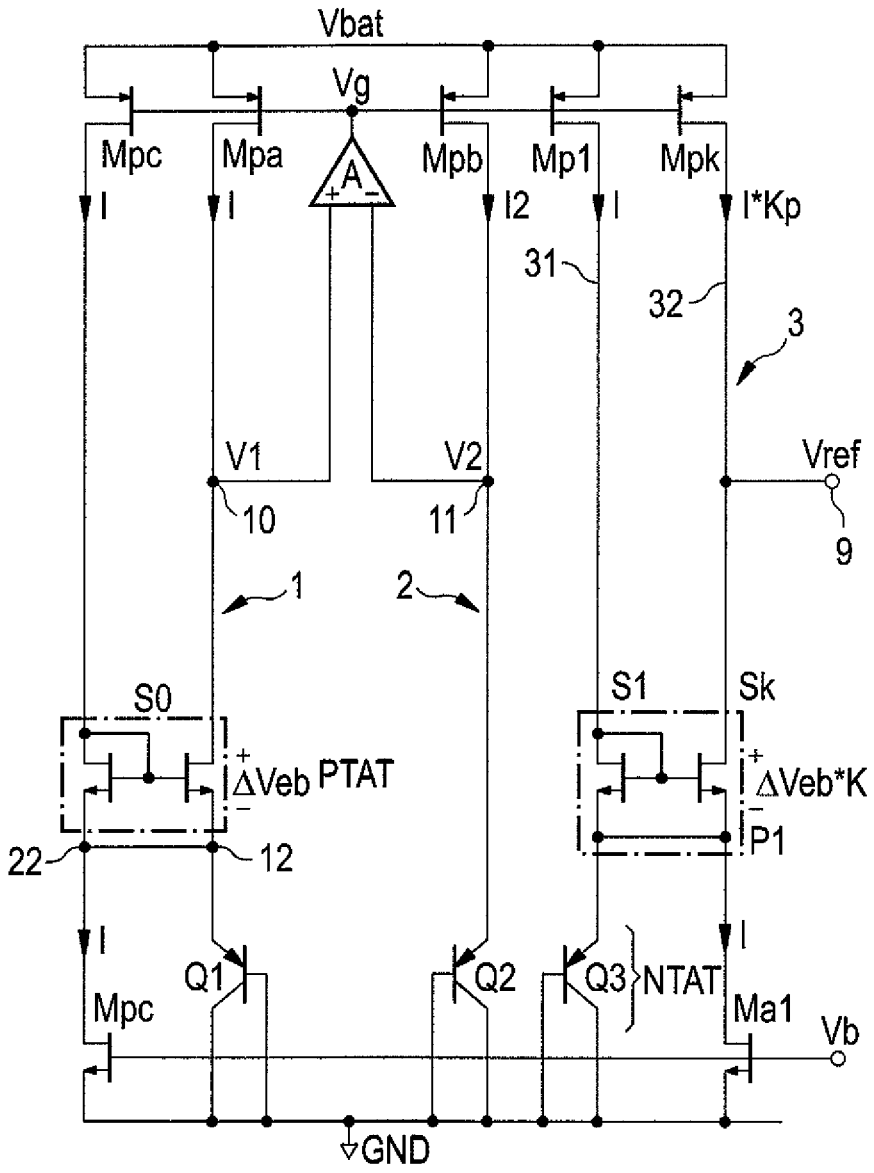
FIG. 4 illustrates a third embodiment of a band gap reference circuit.

FIG. 4 illustrates a slightly different embodiment. In this embodiment, the output branch 3 comprises two sub-branches 31 and 32. The first sub-branch 31 includes transistor Mp1, an input transistor of current mirror S1 and a bipolar transistor Q3 connected in series. Sub-branch 32 comprises transistor Mpk, mirror transistor of current mirror S1 and bias transistor Mal connected in series. The gate terminals of transistors Mp1 and Mpk are both connected to the output of comparator A. The base of transistor Q3 is coupled to ground terminal. Again, the emitter base voltage of transistor Q3 comprises a negative temperature coefficient.

The channel width of the mirror transistor of current mirror S1 representing the second temperature-dependent resistive element is K-times the channel width of the mirror transistor in current mirror S0, whereas the respective channel lengths are substantially equal. Consequently, the output voltage Vref is given by $$Vref=V_{Q3}+\Delta Veb*K,$$

as the mirror transistor of current mirror S1 still operates in a linear region of its characteristics. The output voltage Vref is still kept almost constant with only slight variations over temperature.

In summary, it is possible to keep voltage variations over temperature very small using a plurality of current mirrors acting as level shifters, each of mirror transistors being operated in a linear region of its characteristics or using a mirror transistor in a current mirror, said mirror transistor comprising a channel width being K-times larger than a respective channel width of a mirror transistor arranged in the first branch of the band gap reference.

Figure 5:
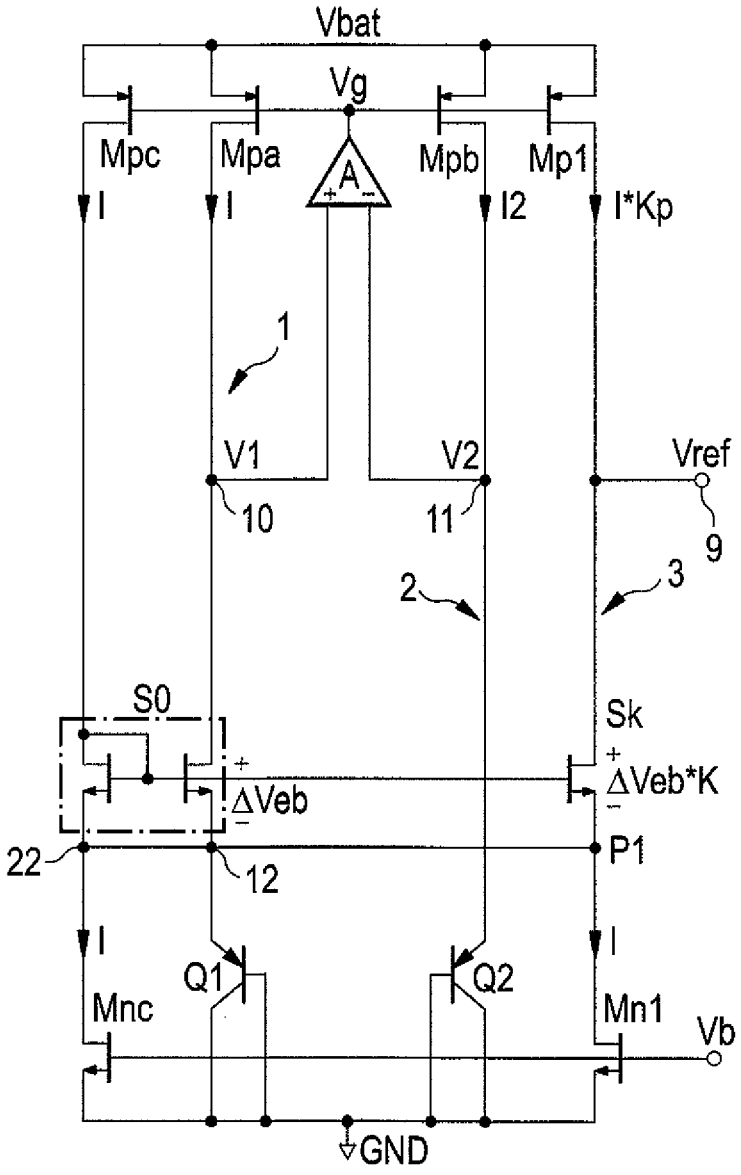
FIG. 5 shows a fourth embodiment of a band gap reference circuit.

To provide a temperature resistive element to compensate the temperature dependency for the output voltage Vref of the band gap reference, FIG. 5 illustrates yet another embodiment.

In this embodiment, the output branch 3 comprises a series connection of transistors Mp1, SK, and bias transistor Mn1. Between transistor SK and bias transistor Mn1, a node P1 is coupled to nodes 12 of the first branch and node 22, respectively. Transistor SK corresponds to a transistor comprising K-times the channel width compared to the mirror transistor of current mirror S0 corresponding to the first temperature-depending element, whereas the respective channel lengths are substantially the same. The gate of transistor Mp1 is again coupled to the output of comparator A.

Transistor Sk in the output branch 3 is controlled to operate in a linear region of its characteristics using the control signal provided by the input transistor of current mirror S0. Input transistor of current mirror S0 is a control element for transistor Sk. Due to its larger channel width, the source-drain voltage across transistor Sk is K-times the voltage across the mirror transistor of element S0.

Accordingly, the output voltage Vref is given by $$Vref=V_{Q1}+K*\Delta Veb,$$

wherein $V_{Q1}$ is the base emitter voltage of bipolar transistor Q1 comprising a negative temperature coefficient. However, this time, the linearity of the output voltage Vref across temperature may decrease compared to the previous embodiments having a current mirror as a temperature-resistive element in the output branch. This is due to the slight non-linearity in the transistor and the floating status of transistor Sk.

Figure 6:
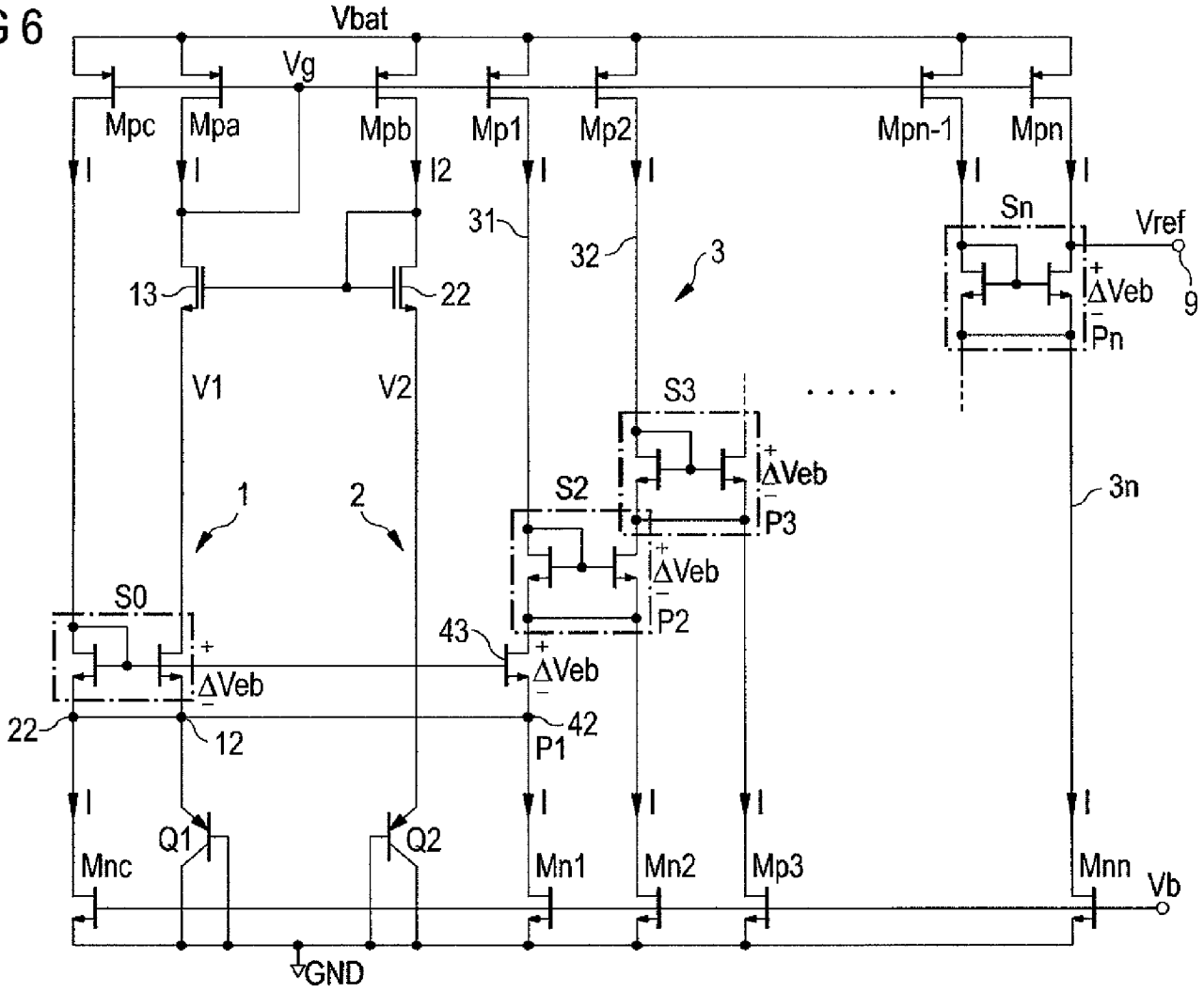
FIG. 6 shows a fifth embodiment of a band gap reference circuit.

In all these embodiments, the voltages V1, V2 at nodes 10 and 11 in the first and second branch in the band gap reference were kept equal using a comparator. FIG. 6 shows a different embodiment in which the control voltage Vg is generated using a different approach. In this embodiment, first branch 1 comprises a series connection of transistor Mpa, transistor 13, the mirror transistor of current mirror S0 representing the first temperature-resistive element and bipolar transistor Q1.

Second branch 2 includes transistor Mpb coupled to transistor 22 and bipolar transistor Q2. The gates of field-effect transistors 13 and 22 are connected together and to a node between transistor Mpb and transistor 22 in the second branch, thereby forming a current mirror. Transistors Mpa and Mpb in the first and second branch, respectively, also form a current mirror, wherein a node between transistor 13 and transistor Mpa is coupled to the control terminals of transistors Mpa and Mpb. The remaining elements of the band gap reference correspond to the embodiment according to FIG. 3. Again, the voltages V1 and V2 in the first and second branch at the respective drain terminals of transistors 13 and 22 are equal.

Figure 8:
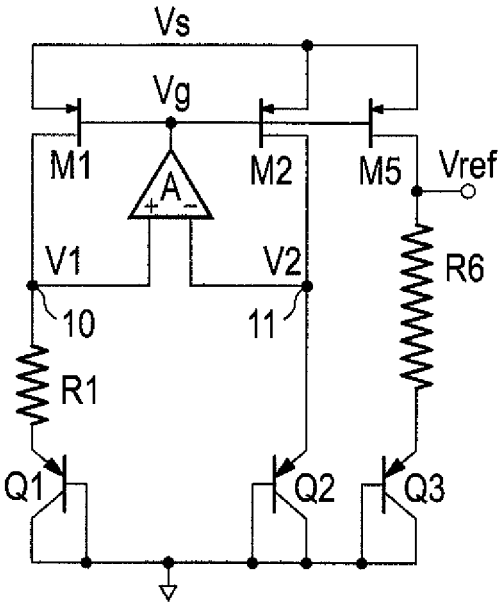
FIG. 8 shows an existing band gap reference.
Figure 7:
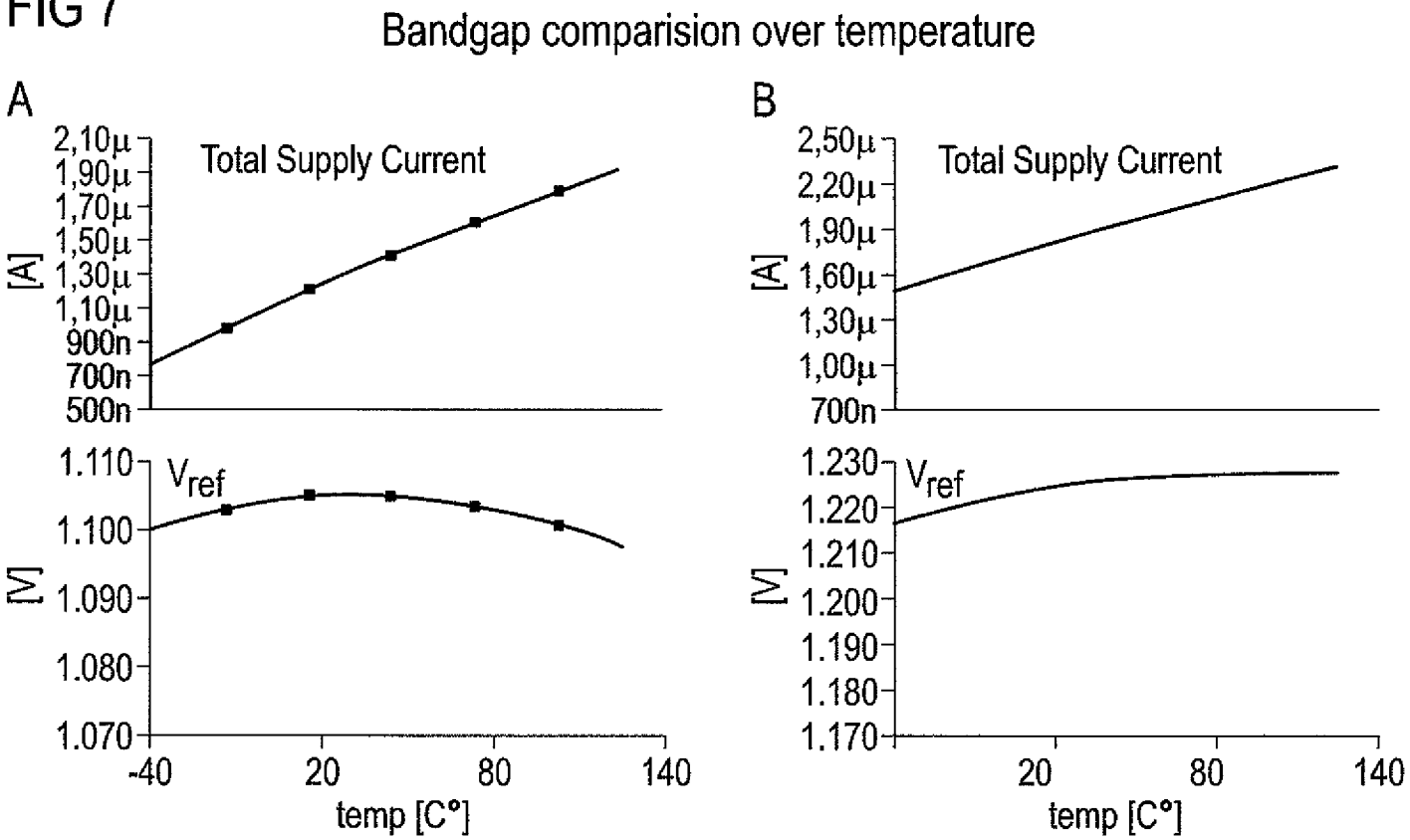
FIG. 7A, 7B illustrate several diagrams showing a voltage and current dependency over temperature.

FIGS. 7A and 7B illustrate a comparison of band gap references according to embodiments of the present invention and the known architecture as illustrated in FIG. 8. The band gap reference according to embodiments of the present invention as shown in FIG. 7A requires a slightly less supply current compared to the known band gap reference illustrated in FIG. 7B. Further, the output voltage Vref of the band gap reference circuit according to embodiments of the present invention illustrated in FIG. 7A shows a smaller temperature dependency compared to the output voltage Vref of the known band gap reference as shown in FIG. 7B. The deviation between 20 and 50° C. is almost zero in the new band gap reference circuit, while the deviation for the known band gap reference between 20° and 60° is approximately 4 mV.

The present invention realizes a band gap reference without resistors, which can be implemented with significant less size as an integrated circuit. For that purpose, field-effect transistors are used instead of poly-resistors. Further, temperature-dependent elements can be implemented using current mirrors wherein the mirror transistor of the current mirror is operated in a linear region of its characteristics implementing a resistive behavior.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

I claim:

1. A band gap reference circuit, comprising:

a first branch comprising a first transistor element and a first temperature dependent resistive element;

a second branch comprising a second transistor element having a size different from the first transistor element;

an output branch comprising an second temperature dependent resistive element, the second temperature dependent resistive element being coupled to an output terminal; and a control element coupled to the first and second branch to control a current through the first and second branches;

wherein each of the first and second temperature dependent resistive elements, comprises a transistor, whose controlled section is arranged in a current path of the respective branch and is controlled such that it operates in its linear region of its characteristics, wherein the first temperature dependent element comprises a first current mirror, the first current mirror comprising a first input transistor and a first mirror transistor, and wherein the second temperature dependent resistive element comprises a second current mirror, the second current mirror comprising a second input transistor and a second mirror transistor.

2. The band gap reference circuit according to claim 1, wherein each control terminal of said first input transistor and said first mirror transistor is coupled to a terminal of the first input transistor.

3. The band gap reference circuit according to claim 1, wherein the first mirror transistor comprises a channel width, which is greater than a respective channel width of the first input transistor.

4. The band gap reference circuit according to claim 1, wherein each control terminal of both said second input transistor and said second mirror transistor is coupled to a terminal of the second input transistor.

5. The band gap reference circuit according to claim 1, wherein the second temperature dependent resistive element comprises a further current mirror, said further current mirror comprising a further input transistor and further mirror transistor, wherein the further input transistor is coupled to an input terminal of the second mirror transistor and each control terminal of both transistors of the further current mirror is coupled to a terminal of the second input transistor.

6. The band gap reference circuit according to claim 1, wherein said second temperature dependent resistive element comprises a plurality of current mirrors, wherein each current mirror comprises an input transistor and a mirror transistor;

wherein each control terminal of both transistors is coupled to a first terminal of the respective input transistor; and wherein a terminal of a current mirror transistor of at least one of the plurality of current mirrors is coupled to a second terminal of an input transistor of a subsequent current mirror.

7. The band gap reference circuit according to claim 1, wherein the respective mirror transistor comprises a channel width which is greater than a respective channel width of the respective input transistor.

8. The band gap reference circuit according to claim 1, wherein the transistor of the second temperature dependent resistive element comprises a channel length, said channel length being greater than a channel length of the transistor of the first temperature dependent resistive element.

9. The band gap reference circuit according to claim 1, wherein the output branch comprises a current transistor element comprising a temperature dependence opposite to the temperature dependence of said second temperature dependent resistive element.

10. The band gap reference circuit according to claim 1, wherein a node between the second temperature dependent resistive element and a ground terminal is coupled to a node between the first temperature dependent resistive element and the first transistor element.

11. The band gap reference circuit according to claim 1, wherein the control element comprises one of the following:

a comparator, whose inputs are coupled to the first and second branch, respectively;

a current mirror, comprising a third mirror transistor arranges in the first branch and an input transistor arranged in the second branch, and a fourth current mirror comprising an input transistor arranged in the first branch and a mirror transistor arranged in the second branch.

12. The band gap reference circuit according to claim 1, wherein the first and second transistor elements, each comprises at least one bipolar transistor, said at least one bipolar transistor comprising a negative proportional temperature dependency.

13. The band gap reference circuit according to claim 1, wherein the output branch comprises a transistor element, said transistor element arranged between the second temperature dependent element and a reference potential terminal with a control terminal of the third transistor element being coupled to the reference potential terminal.

14. The band gap reference circuit according to claim 13, wherein the transistor element of the output branch comprises a temperature dependency similar to the temperature dependency of the first transistor element.

15. The band gap reference circuit according to claim 1, wherein said first temperature dependent resistive element comprises a first current mirror, said first current mirror comprising a first input transistor and a first mirror transistor, wherein each control terminal of both said first input transistor and said first mirror transistor is coupled to a terminal of said first input transistor, wherein said controlled section of said first mirror transistor is directly connected in the current path of the first branch, and wherein said second temperature dependent resistive element comprises a second current mirror, said second current mirror comprising a second input transistor and a second mirror transistor, wherein each control terminal of both said second input transistor and said second mirror transistor is coupled to a terminal of the second input transistor, wherein said controlled section of said second mirror transistor is directly connected in the current path of the output branch.

16. The band gap reference circuit according to claim 15, wherein each mirror transistor comprises a channel width, which is greater than a respective channel width of the corresponding input transistor.

17. The band gap reference circuit according to claim 1, wherein the current path of the first branch and the current path of the output branch are connected between a common supply terminal and a common ground terminal.

18. A band gap reference circuit, comprising:

a first branch comprising a first transistor element and a first temperature dependent resistive element;

a second branch comprising a second transistor element having a size different from the first transistor element;

an output branch comprising a second temperature dependent resistive element, said second temperature dependent resistive element being coupled to an output terminal; and a control element coupled to the first and second branch to control a current through the first and second branches;

wherein said first temperature dependent resistive element comprises a first current mirror, said first current mirror comprising a first input transistor and a first mirror transistor, wherein each control terminal of both said first input transistor and said first mirror transistor is coupled to a terminal of said first input transistor; and wherein said second temperature dependent resistive element comprises a second current mirror, said second current mirror comprising a second input transistor and a second mirror transistor, wherein each control terminal of both said second input transistor and said second mirror transistor is coupled to a terminal of the second input transistor; and wherein each controlled section of each mirror transistor is arranged in a current path of the respective branch.

19. The band gap reference circuit according to claim 18, wherein each mirror transistor comprises a channel width, which is greater than a respective channel width of the corresponding input transistor.

* * * * *